US008122721B2

(12) United States Patent
Johnson et al.

(10) Patent No.: US 8,122,721 B2
(45) Date of Patent: Feb. 28, 2012

(54) COMBUSTION TURBINE ENGINE AND METHODS OF ASSEMBLY

(75) Inventors: Thomas Edward Johnson, Greer, SC (US); James Thomas Brown, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 1002 days.

(21) Appl. No.: 11/325,184

(22) Filed: Jan. 4, 2006

(65) Prior Publication Data

US 2007/0151255 A1 Jul. 5, 2007

(51) Int. Cl.
*F02C 1/00* (2006.01)

(52) U.S. Cl. ..... 60/742; 60/737

(58) Field of Classification Search ..... 60/796, 60/799, 800, 752, 737–748
See application file for complete search history.

(56) References Cited

U.S. PATENT DOCUMENTS

| | | | | |
|---|---|---|---|---|
| 4,341,512 | A | 7/1982 | Wojcieson et al. | |
| 4,891,935 | A * | 1/1990 | McLaurin et al. | 60/800 |
| 5,211,004 | A | 5/1993 | Black | |
| 5,247,790 | A * | 9/1993 | Donlan et al. | 60/800 |
| 5,361,578 | A * | 11/1994 | Donlan | 60/800 |
| 5,636,508 | A * | 6/1997 | Shaffer et al. | 60/800 |
| 5,644,918 | A | 7/1997 | Gulati et al. | |
| 5,685,139 | A | 11/1997 | Mick et al. | |
| 6,112,971 | A | 9/2000 | Castaldo et al. | |
| 6,199,367 | B1 * | 3/2001 | Howell | 60/39.23 |
| 6,450,762 | B1 * | 9/2002 | Munshi | 415/138 |
| 6,883,329 | B1 | 4/2005 | Martling | |
| 6,923,002 | B2 | 8/2005 | Crawley et al. | |
| 2002/0011064 | A1 * | 1/2002 | Crocker et al. | 60/39.06 |
| 2005/0005610 | A1 * | 1/2005 | Belsom et al. | 60/796 |

FOREIGN PATENT DOCUMENTS

| | | |
|---|---|---|
| JP | 02204637 | 8/1990 |
| JP | 02213605 | 8/1990 |
| JP | 06193878 | 7/1994 |
| JP | 2003074855 | 3/2003 |

OTHER PUBLICATIONS

Office Action dated May 24, 2011 for co-pending Japanese patent application 2006-353557.

* cited by examiner

*Primary Examiner* — William Rodriguez
*Assistant Examiner* — Phutthiwat Wongwian
(74) *Attorney, Agent, or Firm* — Armstrong Teasdale LLP

(57) ABSTRACT

A method of assembling a combustion turbine engine in provided. The method includes coupling at least one fuel nozzle inner atomized air tube to a combustor end cover plate body. The method also includes assembling a fuel nozzle insert sub-assembly by inserting at least one flow control apparatus into a fuel nozzle insert sub-assembly body. The method further includes inserting at least one seal between the combustor end cover plate body and the fuel nozzle insert sub-assembly body as well as inserting at least one seal between the combustor end cover plate body and the fuel nozzle insert sub-assembly body. The method also includes coupling the fuel nozzle insert sub-assembly to the combustor end cover plate body. The method further includes inserting at least one bellows onto a bellows support fitting and inserting the bellows support fitting onto a fuel nozzle insert sub-assembly body support surface. The method also includes assembling a fuel nozzle sub-assembly. The method further includes assembling a fuel nozzle assembly by coupling the fuel nozzle sub-assembly to the combustor end cover plate body.

11 Claims, 4 Drawing Sheets

COMBUSTION TURBINE ENGINE AND METHODS OF ASSEMBLY

BACKGROUND OF THE INVENTION

This invention relates generally to rotary machines and more particularly, to methods and apparatus for assembling combustion turbine engines.

Many known combustion turbine engines ignite a fuel-air mixture in a combustor and generate a combustion gas stream that is channeled to a turbine via a hot gas path. Compressed air is channeled to the combustor by a compressor. Combustor assemblies typically have fuel nozzles that facilitate fuel and air delivery to a combustion region of the combustor. The turbine converts the thermal energy of the combustion gas stream to mechanical energy that rotates a turbine shaft. The output of the turbine may be used to power a machine, for example, an electric generator or a pump.

Many known fuel nozzle assemblies have a variety of components manufactured from a variety of materials that are joined together with brazed joints. These materials, including the brazed joints, may have differing thermal growth properties which have differing rates and magnitudes of thermal expansion and contraction.

Fuel nozzle assemblies are normally within near proximity of the combustion region of the combustor assemblies. Due to the near proximity to the combustion regions, the nozzles and their constituent components may experience temperature variations ranging from substantially room temperature of approximately 24° Celsius (C.) (75° Fahrenheit (F.)) to operating temperatures of approximately 1316° C. to 1593° C. (2400° F. to 2900° F.). Therefore, the large range of temperature variations in conjunction with the differing thermal expansion and contraction properties of the fuel nozzle assemblies materials causes stresses in the brazed joints, including the brazed joints associated with combustor end covers and fuel nozzle inserts.

BRIEF DESCRIPTION OF THE INVENTION

In one aspect, a method of assembling a combustion turbine engine in provided. The method includes coupling at least one fuel nozzle inner atomized air tube to a combustor end cover plate body, and assembling a fuel nozzle insert sub-assembly by inserting at least one flow control apparatus into a fuel nozzle insert sub-assembly body. The method further includes inserting at least one seal between the combustor end cover plate body and the fuel nozzle insert sub-assembly body, and within at least a portion of an annular diffusion fuel passage, and inserting at least one seal between the combustor end cover plate body and the fuel nozzle insert sub-assembly body, and within at least a portion of a pre-orifice premix fuel annulus. The method also includes coupling the fuel nozzle insert sub-assembly body to the combustor end cover plate body, inserting at least one bellows onto a bellows support fitting, inserting the bellows support fitting onto a fuel nozzle insert sub-assembly body support surface, and assembling a fuel nozzle sub-assembly by coupling at least one radially outer tube, at least one radially inner tube, at least one intermediate tube, and at least one fuel nozzle mounting flange. The method further includes assembling a fuel nozzle assembly by coupling the fuel nozzle sub-assembly to the combustor end cover plate body.

In another aspect, a fuel nozzle assembly is provided. The fuel nozzle assembly includes a combustor end cover sub-assembly, at least one fuel nozzle insert sub-assembly and a fuel nozzle sub-assembly. The cover sub-assembly includes a combustor end cover plate body. The insert sub-assembly includes an insert body and at least one flow control apparatus. The fuel nozzle sub-assembly includes at lest one tube. The fuel nozzle assembly also includes a plurality of seals. The seals are inserted between the insert body, the end cover plate body and the tube wall.

In a further aspect, a combustion turbine engine is provided. The engine includes a compressor. The engine also includes at least one fuel source, and a combustor in flow communication with the compressor. The combustor includes a fuel nozzle assembly and the fuel nozzle assembly includes a combustor end cover sub-assembly, at least one fuel nozzle insert sub-assembly, and a plurality of seals. The cover assembly includes a combustor end cover plate body. The insert sub-assembly includes an insert body and at least one flow control apparatus. The flow control apparatus is configured to facilitate a substantially repeatable predetermined distribution of fuel within the engine. The seals are inserted between the insert body, the end cover plate body and the tube wall.

DETAILED DESCRIPTION OF THE INVENTION

Figure 1:
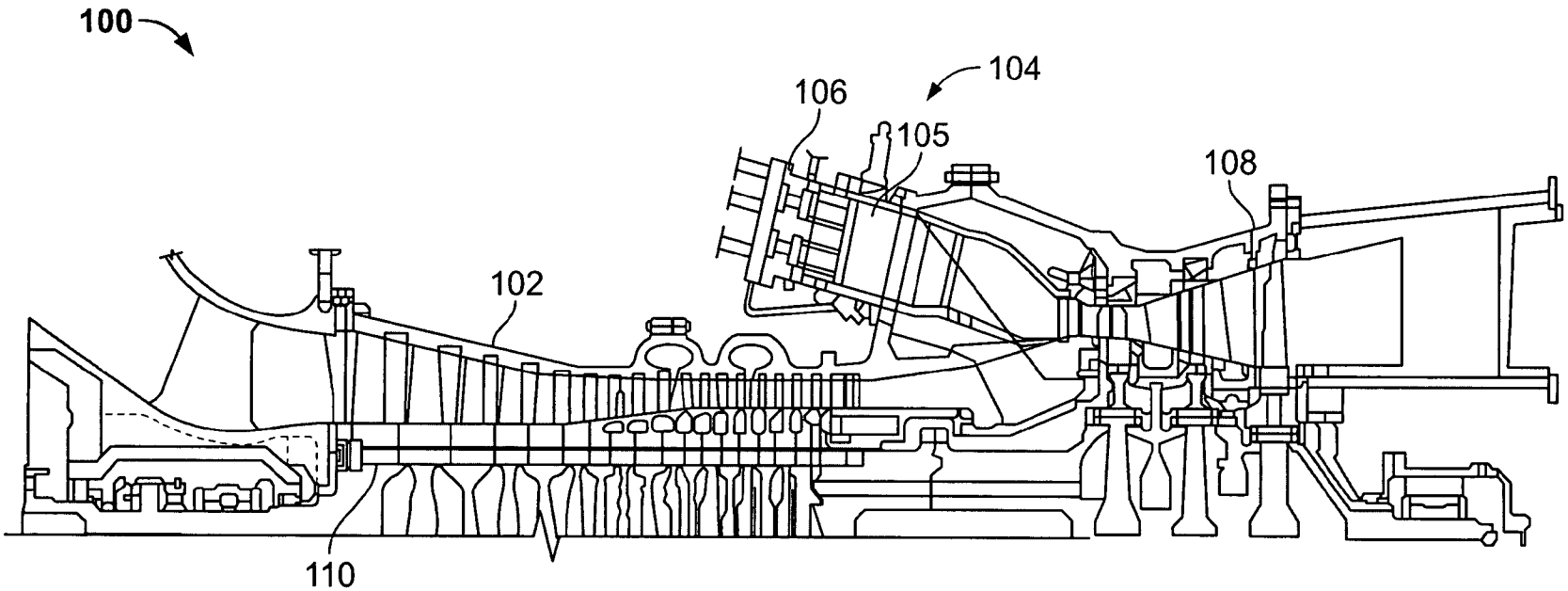
FIG. 1 is a schematic illustration of an exemplary combustion turbine engine.

FIG. 1 is a schematic illustration of an exemplary combustion turbine engine 100. Engine 100 includes a compressor 102 and a combustor 104. Combustor 104 includes a combustion region 105 and a fuel nozzle assembly 106. Engine 100 also includes a turbine 108 and a common compressor/turbine shaft 110 (sometimes referred to as rotor 110). In one embodiment, engine 100 is a MS7001FB engine, sometimes referred to as a 7FB engine, commercially available from General Electric Company, Greenville, S.C. The present invention is not limited to any one particular engine and may be implanted in connection with other engines including, for example, the MS7001FA (7FA), MS9001FA (9FA), and MS9001FB (9FB) engine models of General Electric Company.

In operation, air flows through compressor 102 and compressed air is supplied to combustor 104. Specifically, a substantial amount of the compressed air is supplied to fuel nozzle assembly 106 that is integral to combustor 104. Some combustors have at least a portion of air flow from compressor 104 distributed to a dilution air sub-system (not shown in FIG. 1) and most combustors have at least some seal leakage. Assembly 106 is in flow communication with combustion region 105. Fuel nozzle assembly 106 is also in flow communication with a fuel source (not shown in FIG. 1) and channels fuel and air to combustion region 105. Combustor 104 ignites and combusts fuel, for example, natural gas and/or fuel oil, that generates a high temperature combustion gas stream of approximately 1316° Celsius (C.) to 1593° C. (2400° Fahrenheit (F.) to 2900° F.). Combustor 104 is in flow communication with turbine 108 gas stream thermal energy is converted to mechanical rotational energy. Turbine 108 is rotatably coupled to and drives rotor 110. Compressor 102 also is rotatably coupled to shaft 110. In the exemplary embodiment, there is a plurality of combustors 104 and fuel nozzle assemblies 106. In the following discussion, unless otherwise indicated, only one of each component will be discussed.

Figure 2:
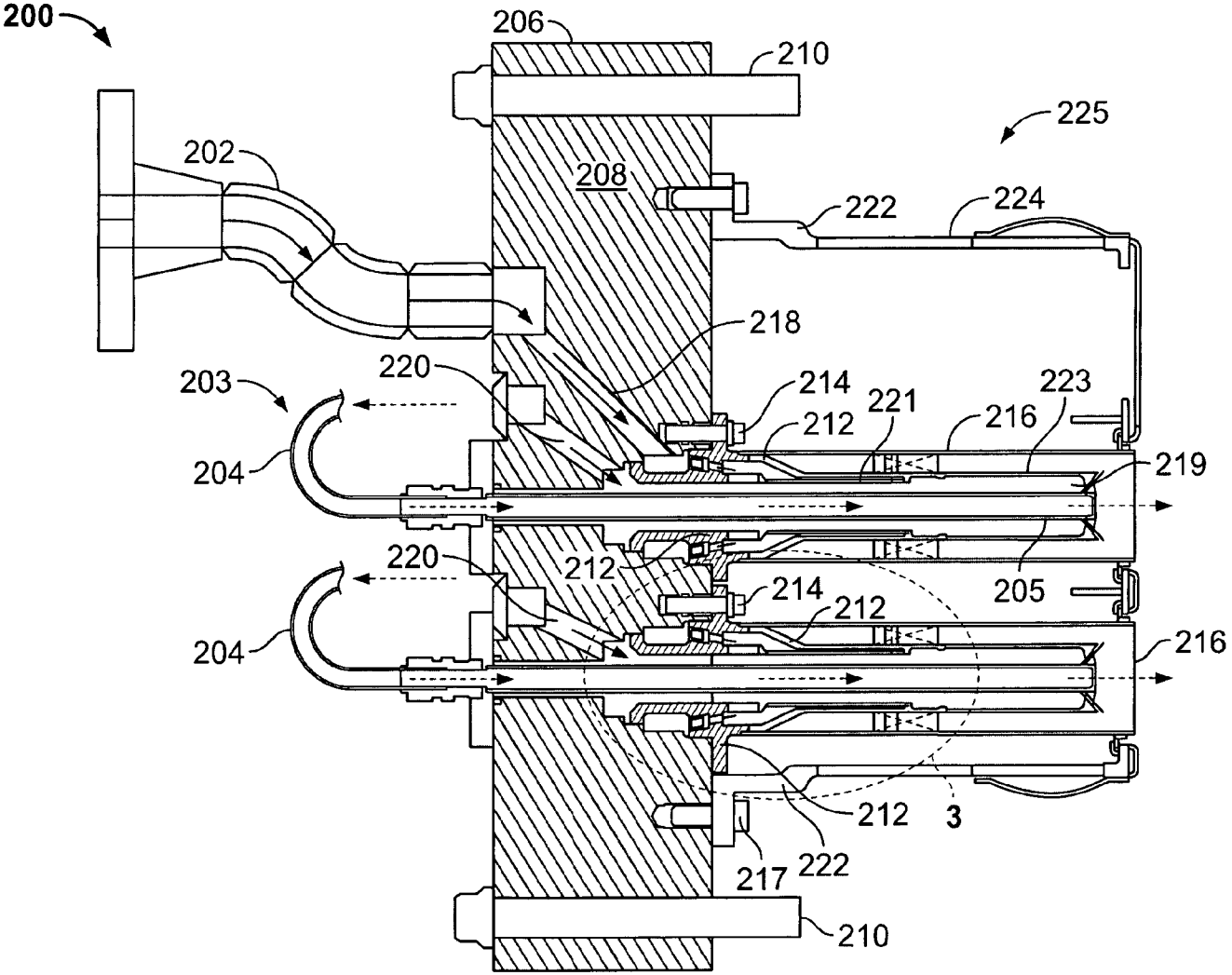
FIG. 2 is a fragmentary illustration of an exemplary fuel nozzle assembly that may be used with the combustion turbine engine in FIG. 1.

FIG. 2 is a fragmentary illustration of an exemplary fuel nozzle assembly 200 that may be used with combustion turbine engine 100 (shown in FIG. 1) as a component of combustor 104 (shown in FIG. 1). Assembly 200 includes at least one fuel supply feed 202, and an atomized air cartridge sub-assembly 203. Sub-assembly 203 includes a plurality of air supply tubes 204 coupled to a plurality of inner atomized air tubes 205. Assembly 200 also includes a combustor end cover sub-assembly 206. Cover sub-assembly 206 includes a plurality of open passages for channeling air and fuel (discussed further below), an end cover plate body 208, and a plurality of end cover-to-combustor casing fasteners 210. In the exemplary embodiment, body 208 is formed using a machining process that includes forming a plurality of cavities within body 208 to subsequently receive, but not be limited to, a plurality of premix fuel supply passages 218, a diffusion fuel supply passage 220, a plurality of atomized air supply tubes 204, a fuel nozzle insert sub-assembly 212 (discussed further below), a plurality of end cover-to-combustor casing fasteners 210, a plurality of insert-to-end cover fasteners 214, and a plurality of cap-to-end cover fasteners 217. Alternatively, an existing model of body 208 may be retrofitted to substantially resemble body 208 of the exemplary embodiment. Cover sub-assembly 206 is coupled to combustor 104 (shown in FIG. 1) casings via fasteners 210. Atomizing air cartridge sub-assemblies 203 are coupled to end cover plate body 208.

Assembly 200 also includes a plurality of fuel nozzle insert sub-assemblies 212 (discussed in more detail below) and a fuel nozzle sub-assembly 225. The fuel nozzle sub-assembly includes a plurality of nozzle radially outer tubes 216, a plurality of intermediate tubes 223, a cap mounting flange 222, a plurality of radially inner tubes 221, an annular diffusion fuel passage 219 and a fuel nozzle cap 224. Fuel nozzle insert sub-assembly 212 is coupled to end cover plate body 208 via fasteners 214. Cap 224 is coupled to end cover plate body 208 via fasteners 217 and cap mounting flange 222.

Fuel is channeled to assembly 200 via at least one supply feed 202 from a fuel source (not shown in FIG. 2). Premix fuel is channeled to tube 216 via passage 218 and fuel nozzle insert sub-assembly 212 as illustrated by the associated arrows. Diffusion fuel is channeled to passage 219 via tube 220 as illustrated by the associated arrows. Combustion air is channeled from compressor 102 (shown in FIG. 1) to air supply tubes 204 from where it is further channeled to tube 205 as illustrated by the associated arrows. Generally, a plurality of fuel nozzle assemblies 200 (only one illustrated in FIG. 2) are arranged circumferentially around shaft 110 (shown in FIG. 1) such that a circumferential stream of combustion gas with a substantially uniform temperature is generated within combustor 104 and channeled to turbine 108 (shown in FIG. 1). A portion of fuel nozzle assembly 200, including insert sub-assembly 212, as illustrated within the dotted lines, is enlarged in FIG. 3 and discussed in more detail below.

Figure 3:
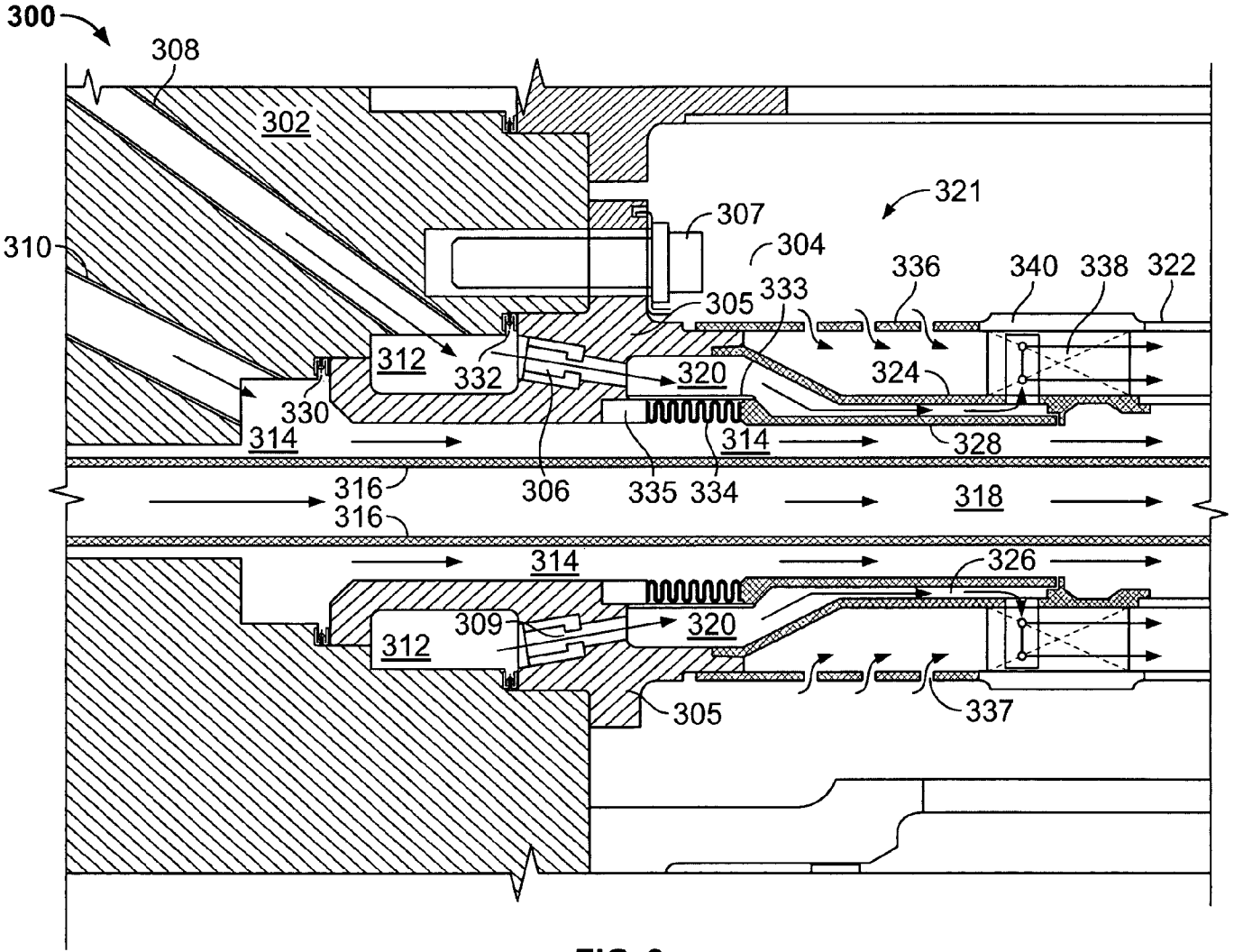
FIG. 3 is an expanded fragmentary illustration of an exemplary fuel nozzle assembly that may be used with the combustion turbine engine in FIG. 1.

FIG. 3 is an expanded fragmentary illustration of an exemplary fuel nozzle assembly 300 that may be used with combustion turbine engine 100 (shown in FIG. 1). Assembly 300 includes an end cover plate body 302 and a fuel nozzle insert sub-assembly 304. Sub-assembly 304 includes a body 305 and a plurality of orifice plugs 306 (only two illustrated in FIG. 3). In the exemplary embodiment, body 305 is formed using a machining process that includes forming a plurality of cavities and passages within body 305 to subsequently receive, but not be limited to, orifice plugs 306 and a plurality of insert-to-end cover fasteners 307 (only one illustrated in FIG. 3). Fuel nozzle insert sub-assembly 304 is assembled via inserting plugs 306 into the associated cavities in body 305. Each orifice plug 306 has at least one orifice opening 309.

Assembly 300 further includes at least one premix fuel supply passage 308 and a diffusion fuel supply passage 310. Passages 308 and 310 are formed in body 302 during a machining process. Assembly 300 further includes a pre-orifice premix fuel annulus 312, an annular diffusion fuel passage 314, an inner atomized air tube 316 that forms an inner atomized air passage 318, a post-orifice premix fuel annulus 320, and a fuel nozzle sub-assembly 321. Fuel nozzle sub-assembly 321 includes a radially outer tube 322, a radially inner tube 328, a premix fuel supply passage 326, and an intermediate tube 324. Annulus 312 is formed during the assembly process as insert body 305 is coupled to body 302. Passage 314 is also formed during the assembly process by tube 316, body 302, body 305, and tube 328. Annulus 320 is formed via body 305 and support fitting 333 (discussed further below). Passage 326 is formed by intermediate tube 324, radially inner tube 328 and insert body 305. Shroud 336 is dimensioned such that the clearance between shroud 336 and body 305 is large enough to facilitate thermal growth and small enough to facilitate mitigating air leakage.

Sub-assembly 300 further includes a first seal 330, a second seal 332, a third seal support fitting 333, a bellows 334 and a bellows support fitting support surface 335.

First seal 330 is an annular W-type seal (referred to as a W-type seal due to the shape that substantially resembles the letter W) that is positioned within the upstream region of passage 314 between end cover plate body 302 and insert sub-assembly 304. Alternatively, seal 330 may be a C-type seal, an E-type seal, or any other seal type that meets or exceeds the predetermined characteristics of a seal used in the operation of assembly 300. Seal 330 is positioned, dimensioned and shaped to facilitate a mitigation of fuel leakage between passage 314 and annulus 312. Seal 330 is positioned between sub-assembly 304 and body 302 within a portion of annular diffusion fuel passage 314.

Second seal 332 is also an annular W-type seal that is positioned within annulus 312 between end cover plate body 302 and insert sub-assembly 304. Alternatively, seal 332 may be a C-type seal, an E-type seal, or any other seal type that meets or exceeds the predetermined characteristics of a seal used in the operation of assembly 300. Seal 332 is positioned, dimensioned and shaped to facilitate a mitigation of fuel leakage between annulus 312 and area outside of shroud 336. Second seal 332 is positioned between sub-assembly 304 and body 302 within pre-orifice premix fuel annulus 312 that is formed by body 302 and body 305.

Bellows 334 is an annular metallic bellows that is positioned within passage 314 between insert sub-assembly 304 and radially inner tube 328. Bellows 334 is positioned, dimensioned and shaped to facilitate a mitigation of fuel leakage between annulus 320 and passage 314 by accommodating thermal growth differentials between tubes 324 and 328. Support fitting 333 includes an annular shape and is positioned over bellows 334. In the exemplary embodiment, seal support 333 is positioned within annulus 320.

Bellows 334 is inserted into fuel nozzle assembly 300. Tube 328 is welded to bellows 334 and is positioned such that a portion of tube 328 is in contact with support fitting 333. Bellows 334 is also welded to fitting support surface 335. A portion of support fitting 333 is brazed to fitting support surface 335 on the annulus 320 side of bellows 334 and facilitates support for bellows 334 to mitigate a potential for buckling or other deformation of bellows 334 that may reduce its sealing effectiveness. Support fitting 333 and body 305 form post-orifice premix fuel annulus 320.

Seals 330 and 332 and bellows 334 are compressed to a predetermined length during assembly (discussed further below) and expand and contract during increasing and decreasing temperature conditions, respectively, throughout the range of operation of engine 100 (shown in FIG. 1). Seals 330 and 332 and bellows 334 may be manufactured of flexible materials that are substantially resistant to high-temperatures. Seals 330 and 332 are inserted into sub-assembly 304 such that they may be reused upon reassembly subsequent to disassembly for maintenance activities.

Insert sub-assembly 304 is coupled to end cover plate body 302 with first seal 330 and second seal 332 correctly positioned. Fasteners 307 (only one illustrated in FIG. 3) are used to couple body 305 to body 302. Fastening body 305 to body 302 compresses seals 330 and 332 to predetermined lengths and maintains seals 330 and 332 in position with a potential for inadvertent removal from the predetermined positions mitigated.

Plugs 306 contain orifices 309 that are positioned within insert body 305 and dimensioned to channel a predetermined rate of premix fuel flow to fuel nozzle sub-assembly 321 such that fuel is substantially evenly distributed across the plurality of nozzles (only one shown in FIG. 3) and substantially complete and uniform fuel combustion at a predetermined temperature is facilitated. Premix fuel enters sub-assembly 300 via at least one supply passage 308 and is channeled to pre-orifice premix fuel annulus 312. Annulus 312 extends circumferentially within combustor 104 around fuel nozzle sub-assembly 321 such that fuel pressure upstream of orifice plugs 306 is substantially similar throughout annulus 312 and facilitates substantially uniform fuel flow to each nozzle sub-assembly 321. Premix fuel is channeled to post-orifice premix fuel annulus 320 that also extends circumferentially around nozzle sub-assembly 321 within combustor 104 such that substantially similar fuel pressure and fuel flow to each nozzle sub-assembly 321 is facilitated. Fuel flow is channeled to combustion region 105 (shown in FIG. 1) via premix fuel supply passage 326, passage 326 being formed with radially inner tube 328 and intermediate tube 324. Premix fuel flow is illustrated with the associated arrows. Orifice plugs 306 are fixedly inserted to insert sub-assembly 304 such that a potential for an orifice-to-nozzle mismatch during reassembly activities subsequent to disassembly for maintenance activities is mitigated.

Diffusion fuel is channeled to combustion region 105 via diffusion supply passage 310 and annular diffusion passage 314. Passage 314 is formed with insert body 305, bellows 334, radially inner tube 328 and inner atomized air tube 316. Diffusion fuel flow is illustrated with the associated arrows.

Air is channeled to combustion region 105 via air tube 316 and air flow is illustrated with the associated arrows.

Assembly 300 also includes a shroud 336 with annular shroud air passages 337, and a plurality of vanes 338 (typically 8 to 12) for mixing air from combustors 104 via passages 337 with fuel from post-orifice premix fuel annulus 320. Vanes 338 include vane shroud 340. The fuel and air mixture is subsequently transported to the fuel nozzle tip (not shown in FIG. 3) by the passage formed by radially outer tube 322 and intermediate tube 324. Vane shroud 340 is welded to shroud 336.

Figure 4:
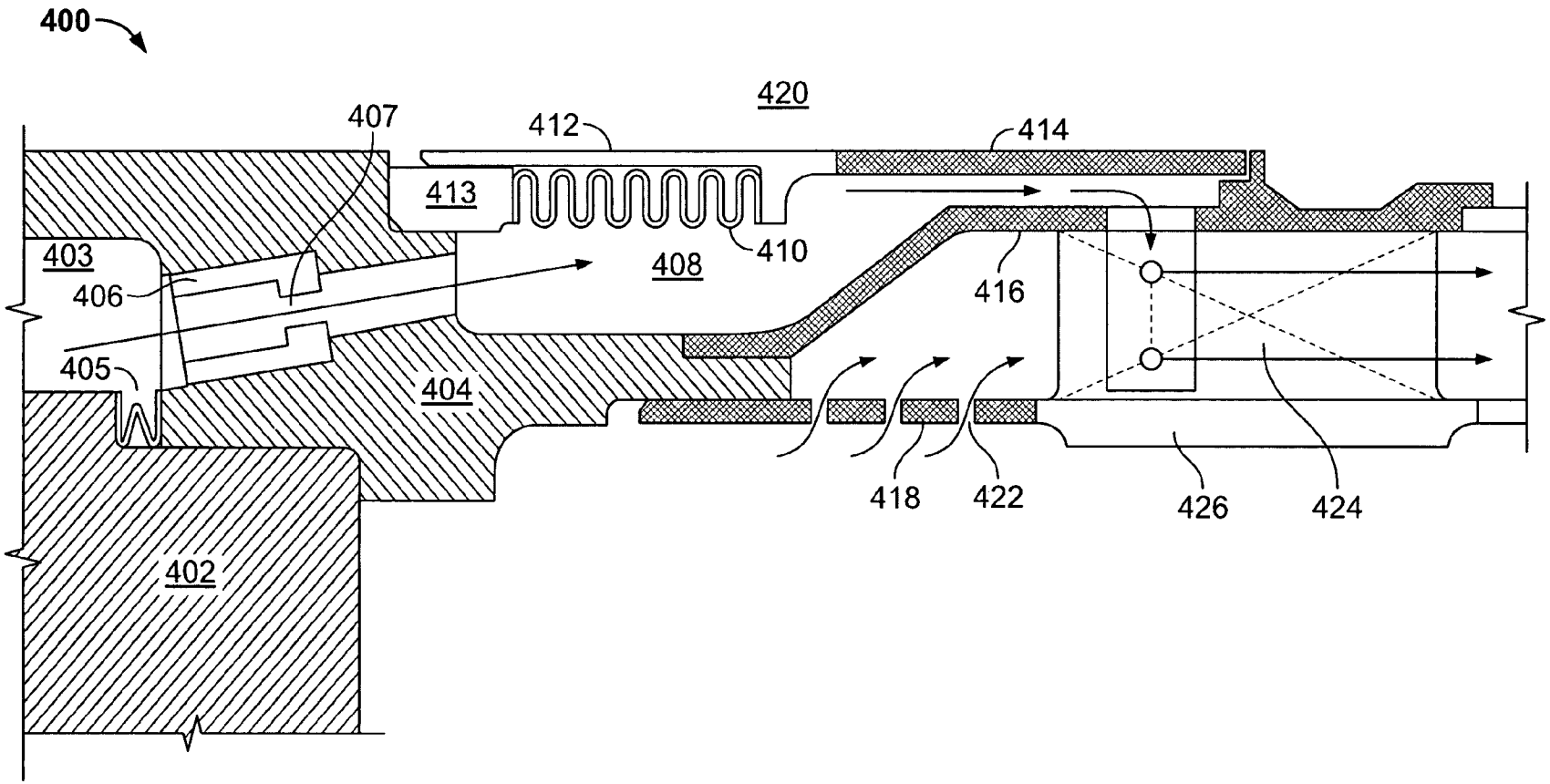
FIG. 4 is a fragmentary illustration of an alternate embodiment of a bellows arrangement that may be used with the combustion turbine engine in FIG. 1.

FIG. 4 is a fragmentary illustration of an alternate embodiment of a bellows arrangement 400 that may be used with combustion turbine engine 100 (shown in FIG. 1). Arrangement 400 includes end cover plate body 402, pre-orifice premix fuel annulus 403, fuel nozzle insert body 404, seal 405, orifice plug 406 with orifice 407, post-orifice premix fuel annulus 408, bellows 410, bellows support fitting 412, bellows support fitting support surface 413, intermediate tube 416, radially inner tube 414, shroud 418 with annular shroud air passages 422, annular diffusion fuel passage 420, vanes 424 and vane shroud 426. In this alternate embodiment, support fitting 412 is positioned on the passage 420 side of bellows 410 as compared to the annulus 408 side of bellows 410 to mitigate tube 414 vibration during operations.

Seal 405 is an annular W-type seal that is positioned within pre-orifice premix fuel annulus 403 formed between end cover plate body 402 and fuel nozzle insert body 404. Alternatively, seal 405 may be a C-type seal, an E-type seal, or any other seal type that meets or exceeds the predetermined characteristics of a seal used in the operation of bellows arrangement 400.

Bellows 410 is welded to fitting 412 on the tube 414 side. Bellows 410 is also welded to bellows support fitting support surface 413. Support surface 413 is brazed to body 404. Support fitting 412 is positioned to have a slip fit contact with support surface 413. Support fitting 412 is welded to tube 414. Shroud 418 is welded to vane shroud 426. Tube 414 is brazed to tube 416. Tube 416 is brazed to body 404 and shroud 418 is positioned to have a contact slip fit with body 404.

Plug 406 contains orifice 407 that is positioned within insert body 404 and dimensioned to channel a predetermined rate of premix fuel flow to annulus 408 such that fuel is substantially evenly distributed across a plurality of nozzles (not shown in FIG. 4) and substantially complete and uniform fuel combustion at a predetermined temperature is facilitated. Assembly 400 in FIG. 4 illustrates air from combustor 104 being channeled through shroud passages 422 to enter vanes 424 and mix with premix fuel being channeled to vane 424 from annulus 408. The fuel and air mixture is subsequently transported to the fuel nozzle tip (not shown in FIG. 4).

The methods and apparatus for a fuel nozzle assembly described herein facilitate operation of a combustion turbine engine. More specifically, designing, assembling, installing and operating a fuel nozzle assembly as described above facilitates operation of a combustion turbine engine by mitigating fuel losses within a fuel nozzle. Also, insertion of reusable seals within the fuel nozzle assemblies may mitigate seal replacement activities. Furthermore, fixedly coupling orifice plugs to a fuel nozzle insert sub-assembly mitigates the potential for erroneously installing the orifice plugs in an alternate insert sub-assembly. As a result, facilitation of a uniform fuel-to-air ratio is enhanced and degradation of combustion turbine efficiency, the associated increase in fuel costs, extended maintenance costs and engine outages may be reduced or eliminated.

Although the methods and apparatus described and/or illustrated herein are described and/or illustrated with respect to methods and apparatus for a combustion turbine engine, and more specifically, a fuel nozzle assembly, practice of the methods described and/or illustrated herein is not limited to fuel nozzle assemblies nor to combustion turbine engines generally. Rather, the methods described and/or illustrated herein are applicable to designing, installing and operating any system.

Exemplary embodiments of fuel nozzle assemblies as associated with combustion turbine engines are described above in detail. The methods, apparatus and systems are not limited to the specific embodiments described herein nor to the specific fuel nozzle assembly designed, installed and operated, but rather, the methods of designing, installing and operating fuel nozzle assemblies may be utilized independently and separately from other methods, apparatus and systems described herein or to designing, installing and operating components not described herein. For example, other components can also be designed, installed and operated using the methods described herein.

While the invention has been described in terms of various specific embodiments, those skilled in the art will recognize that the invention can be practiced with modification within the spirit and scope of the claims.

What is claimed is:

1. A fuel nozzle assembly communicatively coupled to a fuel source, said fuel nozzle assembly comprising:

a combustor end cover sub-assembly, said cover sub-assembly comprising a combustor end cover plate body;

at least one fuel nozzle insert sub-assembly comprising an insert body and a plurality of orifice plugs inserted into said insert body, each of said plurality of orifice plugs comprising at least one orifice defined therein, said at least one fuel nozzle insert sub-assembly removably coupled to said combustor end cover plate body using a plurality of fasteners;

a fuel nozzle sub-assembly comprising an inner tube wall and an outer tube wall that coupled to a shroud having a plurality of air passages therethrough, wherein said combustor end cover plate body, said insert body, and said inner tube wall define a fuel supply passage that is communicatively coupled to the fuel source and said outer tube wall define a premix fuel supply passage; and a plurality of seals between said insert body, said end cover plate body, and said tube wall, said plurality of seals comprising at least one substantially annular bellows inserted between said insert body and said inner tube wall within said fuel passage.

2. A fuel nozzle assembly in accordance with claim 1 wherein said at least one orifice is defined within said insert body and is dimensioned to facilitate predetermined fuel flow rates and patterns associated with said fuel nozzle assembly.

3. A fuel nozzle assembly in accordance with claim 1 wherein each of said orifice plugs is fixedly inserted into said insert body such that a potential for incorrectly altering predetermined fuel flow rates and patterns is mitigated.

4. A fuel nozzle assembly in accordance with claim 1 wherein said plurality of seals comprises at least one substantially annular seal inserted between said insert body and said end cover plate body within at least a portion of an annular diffusion fuel passage.

5. A fuel nozzle assembly in accordance with claim 1 wherein said plurality of seals further comprises at least one substantially annular seal inserted between said insert body and said end cover plate body within at least a portion of a pre-orifice premix fuel annulus.

6. A fuel nozzle assembly in accordance with claim 1 wherein said plurality of seals further comprises at least one of W-seals, C-seals, and E-seals.

7. A combustion turbine engine, said engine comprising:

a compressor;

at least one fuel source; and a combustor in flow communication with said compressor, said combustor comprising:

a fuel nozzle assembly communicatively coupled to said at least one fuel source, said fuel nozzle assembly comprising: a combustor end cover sub-assembly, at least one fuel nozzle insert sub-assembly, a fuel nozzle sub-assembly, and a plurality of seals;

said combustor end cover sub-assembly comprising: a combustor end cover plate body;

said at least one fuel nozzle insert sub-assembly comprising: an insert body and a plurality of orifice plugs inserted into said insert body, said plurality of orifice plugs comprising at least one orifice defined therein, said at least one fuel nozzle insert sub-assembly removably coupled to said combustor end cover plate body using a plurality of fasteners, said flow control apparatus configured to facilitate a substantially repeatable predetermined distribution of fuel within the engine;

said fuel nozzle subassembly comprising: an inner tube wall, an outer tube wall that coupled to a shroud having a plurality of air passages therethrough, said combustor end cover plate body, said insert body, said at inner tube wall defining a fuel supply passage that is communicatively coupled to said at least one fuel source and said outer tube wall defining a premix fuel supply passage, said plurality of seals inserted between said insert body, said combustor end cover plate body and said inner tube wall, said plurality of seals comprising at least one substantially annular bellows inserted between said insert body and said inner tube wall.

8. A combustion turbine engine in accordance with claim 7 wherein said at least one orifice is defined within said insert body and is dimensioned to facilitate predetermined fuel flow rates and patterns associated with said fuel nozzle assembly.

9. A combustion turbine engine in accordance with claim 7 wherein each of said orifice plugs is fixedly inserted into said insert body such that a potential for incorrectly altering predetermined fuel flow rates and patterns is mitigated.

10. A combustion turbine engine in accordance with claim 7 wherein said plurality of seals comprises at least one substantially annular seal inserted between said insert body and said combustor end cover plate body within at least a portion of said annular diffusion fuel passage.

11. A combustion turbine engine in accordance with claim 7 wherein said plurality of seals further comprises at least one substantially annular seal inserted between said insert body and said combustor end cover plate body within at least a portion of a pre-orifice premix fuel annulus.

* * * * *